United States Patent [19]

Cobb

[11] Patent Number: 4,669,407

[45] Date of Patent: Jun. 2, 1987

[54] BODY SAIL

[76] Inventor: Ronald E. Cobb, P.O. Box 876, Brighton, Mich. 48116

[21] Appl. No.: 791,427

[22] Filed: Oct. 25, 1985

[51] Int. Cl.[4] ..... B63H 9/04

[52] U.S. Cl. ..... 114/39; 114/90; 114/98; 114/102; 114/105

[58] Field of Search ..... 114/39, 39.2, 90, 97-99, 114/102, 105, 204, 111; 441/65, 129, 136

[56] References Cited

U.S. PATENT DOCUMENTS

| | | | |
|---|---|---|---|
| 1,743,396 | 1/1930 | Robertson, Jr. | 114/39 |
| 2,106,209 | 1/1938 | Edge | 114/102 X |
| 3,473,502 | 10/1969 | Wittkamp | 114/39 |
| 3,771,181 | 11/1973 | Dansereau | 9/329 |
| 3,982,766 | 9/1976 | Budge | 280/1 |
| 4,047,492 | 9/1977 | Brown | 114/39 |
| 4,269,133 | 5/1981 | Brown | 114/103 |
| 4,347,799 | 9/1982 | Moriarty | 114/105 X |

*Primary Examiner*—Sherman D. Basinger

*Attorney, Agent, or Firm*—Basile, Weintraub & Hanlon

[57] ABSTRACT

A body sail device mountable around the body of a user for propelling the user through the water. The body sail includes an upstanding mast and a mounting member attachable on the body of the user for mounting the mast on the user. An outwardly extending boom is attached to the mast. At least one and preferably two sails are attached to the boom mast. A guide assembly is pivotally attached to one of the sail for controlling the trim of the sail with respect to the boom and mast.

14 Claims, 6 Drawing Figures

BODY SAIL

BACKGROUND OF THE INVENTION

1. Field of the Invention

This invention relates, in general, to water recreational devices and, more specifically, to sailing devices.

2. Description of the Prior Art

Several devices have been developed to propel individuals through the water by means of wind currents. Typically, a sail is mounted on a floatable device such as an air mattress, float, etc. on which the user reclines. Other types of sailing devices mount the sail on a floatable support member or board on which the user stands or lays. However, the use of such floats increases the complexity and cost of these sailing devices and do not provide a sufficient amount of control of the sail in the water. Particularly, since the previously devised body usable sail devices rigidly mount the sail to a floatable device, such as a surf board, air mattress or raft, etc., in certain wind and water conditions, these body sails have a tendency to twist thereby causing a rolling movement of the user which makes control of the body sail difficult.

Thus, it would be desirable to provide a device which overcomes the problems of previously devised body sailing devices. It would also be desirable to provide a body mountable sailing device which is easy to operate. It would also be desirable to provide a body sailing device which is formed of a minimum number of lightweight components which can be folded up for easy transport or storage. Finally, it would be desirable to provide a body sailing device which is adjustable for receiving different sized sails as well as to enable its use in varying weather conditions.

SUMMARY OF THE INVENTION

The present invention is a body sail device which is attachable to the body of a user for propelling the user through the water. The body sail of the present invention includes an upstanding mast. Preferably, the mast is formed of two telescoping sections for vertical adjustability. The lower end of the mast is received in a mounting means or base which is movably mountable about the body of the user. The bottom end of the mast is releasably mounted in the base or mounting means to permit full movement of the mast and attached sail or sails around the body of the user.

A boom formed of first and second members is adjustably attached on the mast and extends substantially perpendicular outward from the mast. Preferably, an attachment means is adjustably mounted on the mast and pivotally receives one end of each of the first and second boom members. At least one of the boom members are formed of two telescoping members for adjustability in carrying different sized sails. A main sail is attached between one of the boom sections and the mast. A pair of guide members are pivotally mounted to the attachment means and movably receive a line attached to a second or jib sail. This provides adjustability in the trim of the jib sail to permit easy control and movement of the body sail of the present invention through the water.

The body sail of the present invention is movably attached about the body of the wearer. This enables the mounting means, mast and sails to move around to either side of the body of the wearer when in use so as to provide precise control of the body sail of the present invention in different weather and water conditions. Furthermore, in high winds or when the user simply wishes to stop movement in the water, the user can simply let go of the boom such that the mast and the sails will pivot about the body of the user until they reach the water or will separate completely from the base mounting means. At the same time, however, the sail(s) can be easily re-attached to the user and raised to a vertical position for re-use.

The body sail of the present invention overcomes many of problems encountered with previously devised body sail. The body sail of the present invention is directly attachable on the user and is completely movable about the body of the user to provide easy control of the direction of movement of the user in the water in all types of weather conditions.

The body sail of the present invention is constructed of a minimum number of lightweight components for a low manufacturing cost and quick collapsibility for ease of transport and/or storage. Finally, the body sail of the present invention may be adjusted to receive different sized sails as well as to position the boom at varying heights along the center mast for different sailing conditions as well as the convenience of the user depending upon the particular use of the body sail.

BRIEF DESCRIPTION OF THE DRAWING

The various features, advantages and other uses of the present invention will become more apparent by referring to the following detailed description and drawing in which.

DESCRIPTION OF THE PREFERRED EMBODIMENTS

Figure 2:
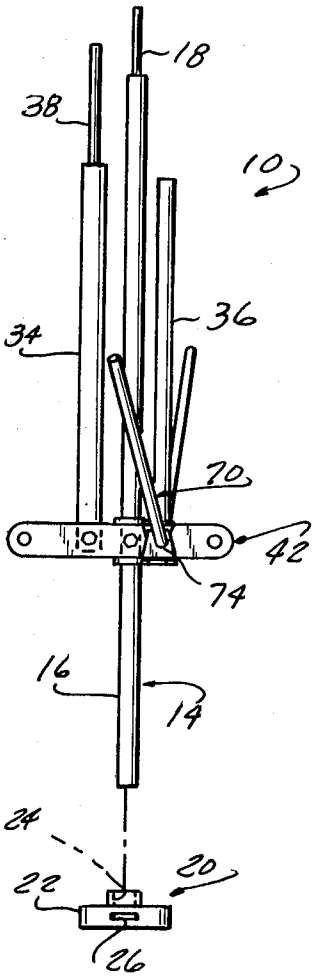
FIG. 2 is a front-elevational view showing the body sail of FIG. 1 in its folded, transportable position.

Throughout the following description and drawing, an identical reference number is used to refer to the same component shown in multiple figures of the drawing.

Figure 1:
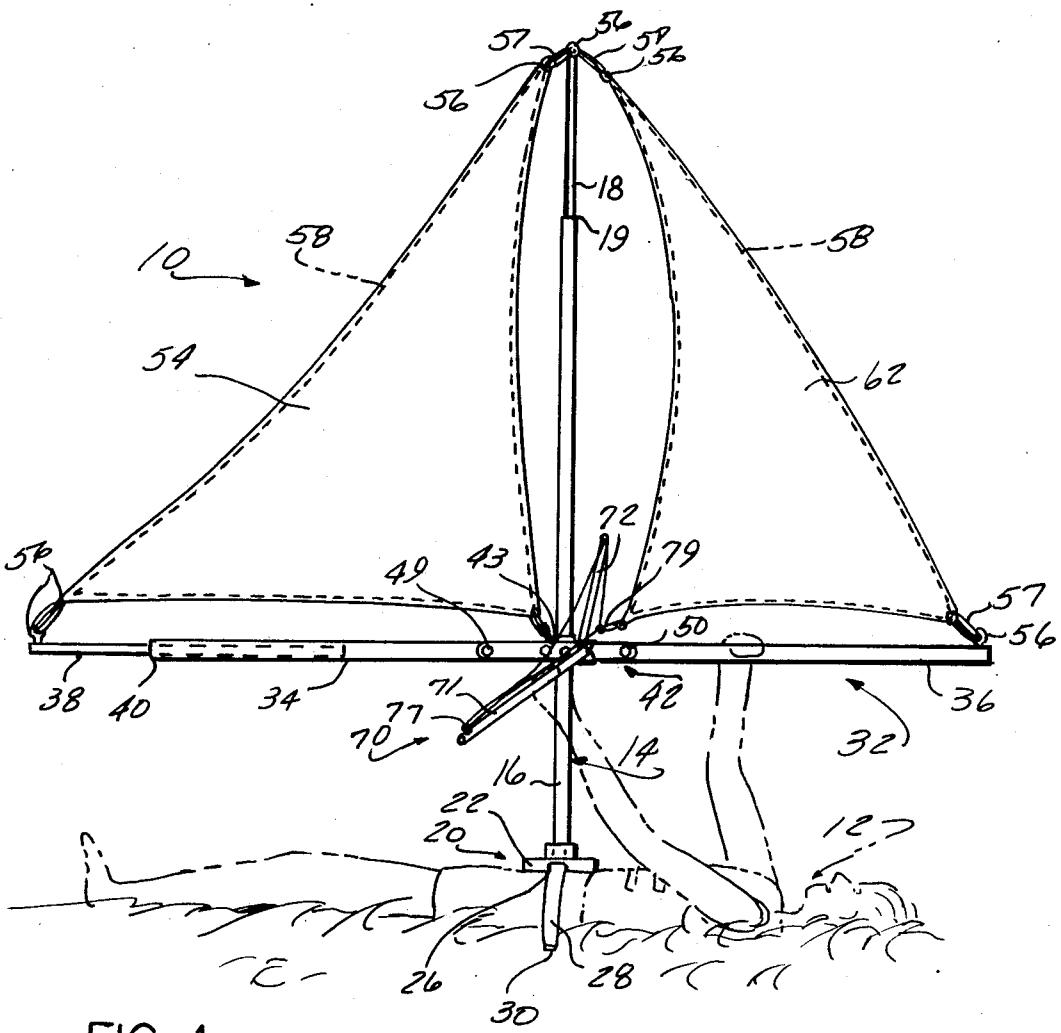
FIG. 1 is a side-elevational view of one embodiment of the body sail of the present invention.

Referring to the drawing, and to FIG. 1 in particular, there is illustrated a body sail 10 which is mountable on the body of a user 12 and may be used to propel the user through the water.

Although the body sail 10 of the present invention can be mounted on the body of the wearer used exclusively by itself to propel the wearer through water, it is preferred that the user also be wearing a suitable floatation device, such as a life preserver, water ski vest, water ski belt, etc., or laying on a floatable apparatus such as an air mattress, a boat, canoe, a surfboard, etc. Depending upon the particular use of the body sail 10 of the present invention, the body sail 10 is rotatably mounted about the body of the wearer or the floatation device, such as the seat of a canoe.

The body sail 10 includes a upstanding mast 14. Preferably, the mast 14 is formed of first and second telescopingly extendable sections 16 and 18, respectively. Suitable locking means such as friction fit connectors 19 are provided for locking the extendable section 18 in the desired extended position in the lower mast section 16. This enables different sized sails, to be mounted on the body sail 10 of the present invention.

Mounting means 20 are provided for pivotally mounting the mast 14 on the body of the user 12. Preferably, the mounting means 20 includes a disc-shaped member 22 having a centrally located aperture 24 which removably and rotatably receives the lower end of the boom 14. The disk shaped member 22 is formed with opposed apertures 26, only one of which is shown in FIGS. 1 and 2. The apertures 26 slidingly receive a belt 28 therethrough. The belt 28 is provided at its opposite, open ends with a releasable clasp mechanism 30 which enables the belt 28 to be removably and adjustably mounted about the body of the user 12. In this manner, when the user 12 is in a reclined position in the water, the mast 14 extends vertically upward and is fully movable around the body of the user 12.

A boom denoted in general by reference number 32 is pivotally mounted on the mast 14 substantially perpendicular to the mast 14. Preferably, the boom 32 is formed of first and second members or sections 34 and 36, respectively. At least one of the boom members, such as a first member 34, is formed of a pair of telescoping members 38 and 40 to provide adjustability in the length of the boom 32 for mounting different sized sails on the body sail 10. Again, suitable locking means, such as set screws, releasable pins, friction connections, etc., are provided for holding the members 38 and 40 in any desired extended position.

Figure 3:
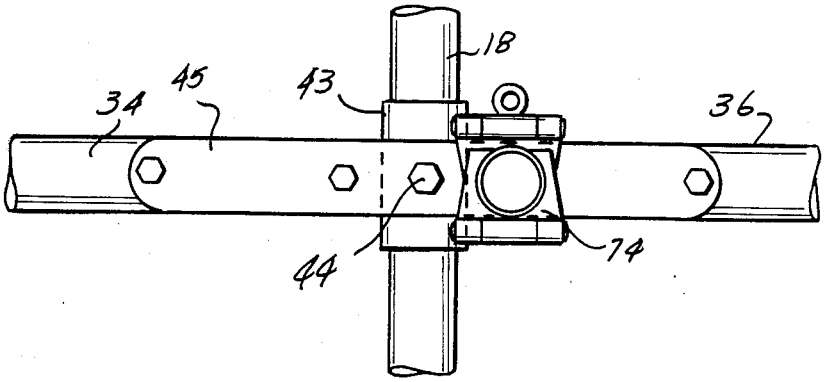
FIG. 3 is an enlarged, partial view showing the interconnection of the boom members to the central mast.

One end of each of the boom sections 34 and 36 is pivotally connected to the mast 14 by an attachment means. As shown in FIG. 1, and in greater detail in FIGS. 3 and 5, the attachment means includes a sleeve 43 which slidably receives the mast 14 therethrough. The sleeve 43 includes an aperture which receives a threadable set screw 44 which extends through one of a pair of spaced side plates 45 and 46 positioned on opposite sides of the mast 14.

The side plates 45 and 46 have a generally planar form and have two pairs of spaced apertures formed at opposite ends and at an intermediate porton or inner mast. The innermost apertures, as shown in the orientation depicted in FIG. 5, of both side plates 45 and 46 are alignable and receive a fastening means 47 and 48, respectively, such as a pivot pin, etc., therethrough which also extends through apertures formed in one end of the boom members 34 and 36, respectively. This provides a pivotal connection enabling the boom members 34 and 36 to be raised to the storage position or dropped to the outwardly extending, position substantially perpendicular to the mast 14 as shown in FIG. 1.

The outermost apertures in the side plates 45 and 46 also receive removable fasteners 49 and 50, such as wing nuts and bolts, which secure the boom members 34 and 46 in their lowered, extended positions and yet are removable to enable the boom members 34 and 36 to be raised to the storage or transport position as described hereafter.

A first or main sail 54 having a generally triangular form is mounted between the first section 34 of the boom and the mast 14. The main sail 54 is formed of any suitable water resistant material, such as nylon, cloth, etc., and is provided with folded over side edges which are joined together along lines 54 to form a hollow passageway through which lines or cords 58 extend.

Eyelets 56 are mounted on the boom member 36 at the upper end of the mast 14. Suitable connectors, such as snap rings etc., 57 are removably attachable to the eyelets 56 and carrying lines 58 mounted through the edges of the sail 54 for removably attaching the sail 54 to the mast 14 and the boom member 34.

In the embodiment shown in FIG. 1, a second sail 62 in the form of a fore or jib sail is mounted on the body sail apparatus 10 of the present invention between the boom section 36 and the mast 14. The fore sail 62 also as a triangular configuration is provided with lines 58 extending through the edges thereof which are connected at the respective ends to connectors 57. The connectors 57 are likewise removably attachable to eyelets 56 mounted at one end of the boom section 36 and the upper end of the mast 14.

Guide means 70 are also provided for enabling the user of the body sail 10 of the present invention to change the direction or trim of fore sail 62 so as to control the direction of movement of the body sail through the water. The guide means 70 preferably includes at least one and preferably, two handles 71 and 72 which extend outward from and substantially perpendicular to the boom 32 adjacent to the mast 14. The handles 71 and 72 are pivotally mounted to the plate members 45 and 46, respectively, by means of a U-shaped hinge assembly each of which includes a hinge 73 which is mounted on each of the plate members 45 and 46 and two outwardly extending ribs 74 which are pivotally connected to each hinge 73. Connectors 75 and 76 extend through the rib members 74 and the handles 71 and 72 to securely attach the handles 71 and 72 to the plate members 45 and 46 as well as to the mast 14 and boom 32.

Figure 5:
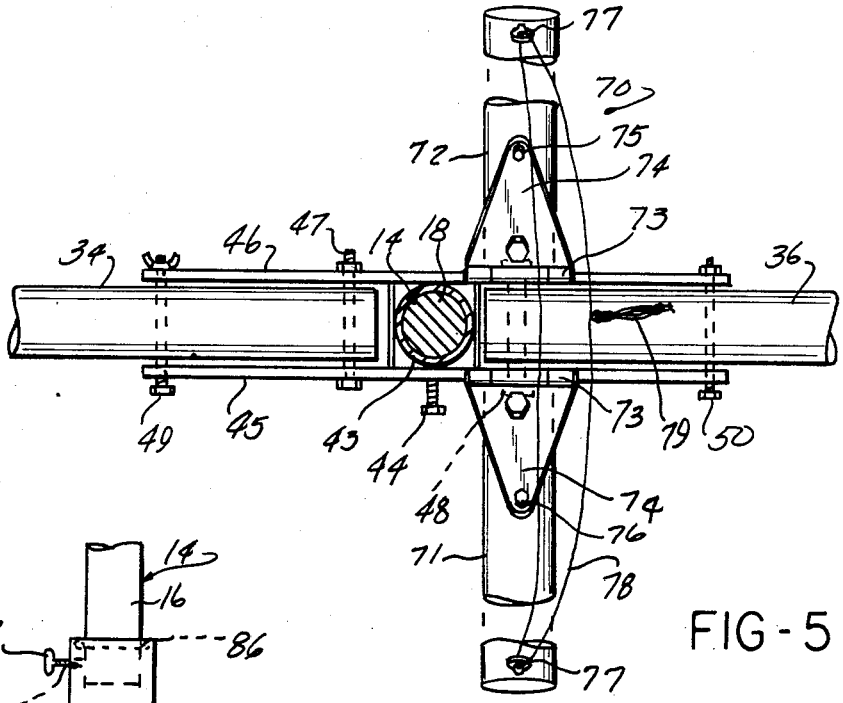
FIG. 5 is a cross-sectional view generally taken along line 5—5 in FIG. 1.

Eyelets, such as eyelet 77 shown in FIG. 5, are mounted at the outward ends of each of the handles 71 and 72 and slidably receive a line 78 which is connected by a snap-on connector 79 to one edge of the fore sail 62. This enables sliding movement of the line 78 through the eyelets 77 and enables the user to adjust the direction and curvature of the fore sail 62 depending upon the weather and water conditions and the direction which he or she wishes to take in the water.

All of the connectors 79 and 57 are releasably attachable to the ends of the boom 32 and the mast 14 to enable the sails 54 and 62 to be removed if desired during transport or storage.

Referring now to FIG. 2, there is illustrated the body sail device 10 of the present invention is a substantially folded up, transportable position. Due to the pivotal connection of one end of each of the boom membera 34 and 36 to the attachment means 42, the boom members 34 and 36 may be pivoted to an upright position where they are disposed adjacent to the mast 14 after the connectors 49 and 50 are removed. This enables the body sail device 10 of the present invention to be folded into a compact form for easy transport or storage. The sails 54 and 62 may be removed from the mast 14 and boom members 34 and 36 or retained thereon and merely folded about the collapsed mast 14 and boom members 34 and 36.

Figure 4:
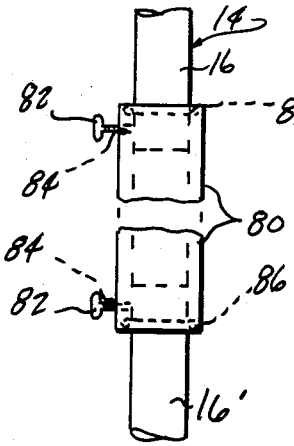
FIG. 4 is an enlarged, partial view of another embodiment of the body sail of the present invention.

Referring now to FIG. 4, there is illustrated another embodiment of the present invention. In this embodiment, the main mast 14 is provided with a removable extension member 80. The extension member 80 has an elongated, hollow, cylindrical form and may be constructed in any desired length to increase the overall height of the mast 14 when used. The mast section 16 itself is separated into two separable portions 16 and 16' as shown in FIG. 4. The extension member 80 fits between the separated ends of the mast sections 16 and 16'. The outer diameter of the extension member 80 is greater than the outer diameter of the mast sections 16 and 16' such that the mast sections 16 and 16' telescopingly fit within opposed ends of the extension member 80.

Suitable fasteners, such as set screws 82, extend through apertures 84 formed in opposed ends of the extension member 80 to engage the ends of the mast sections 16 and 16' to thereby securely hold the mast sections 16 and 16' in the desired position within opposite ends of the extension member 80 thereby increasing the overall height of the mast 14 as desired depending upon weather conditions, sail height, etc.

Suitable sealing means, such as O-rings 86, are positioned in recesses formed at the ends of the extension member 80 to seal the interior of the extension member 80 from water.

Optionally, the interior of the extension member 80 as well as the entire mast 14 may be filled with a suitable, lightweight material, such as a plastic, which is impervious to the affects of water to prevent water from becoming trapped within the interior of the mast 14 or extension member 80.

Figure 6:
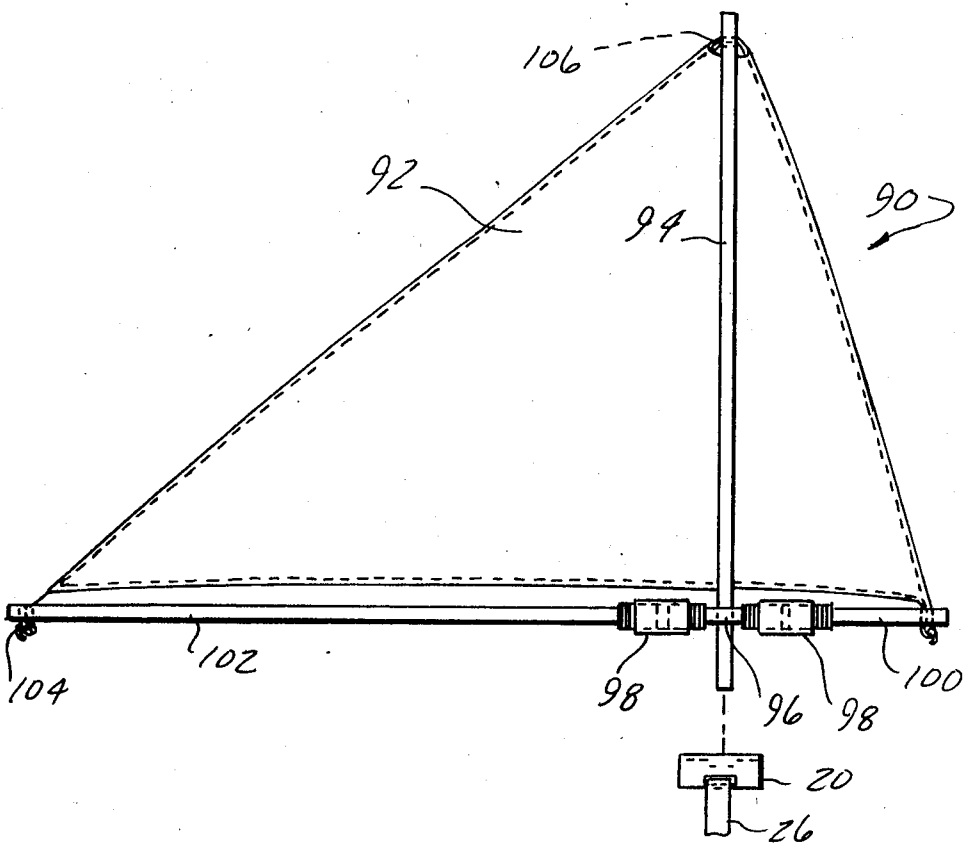
FIG. 6 is a side elevational view of yet another embodiment of the body sail of the present invention.

Referring now to FIG. 6, there is illustrated another embodiment of the body sail of the present invention. In this embodiment, the body sail 90 is formed with a single sail 92. The mast has a single elongated form and is connected to a central, perpendicular boom member 96. The outer ends of the central boom member 96 are threadingly or frictionally attachable to connectors 98 at one end; which connectors receive outwardly extending boom members 100 and 102, respectively. The outer ends of the boom members 100 and 102 receive lines 104 extending through the exterior edges of the sail 92 to attach the exterior ends of the sail 92 to the boom members 100 and 102. An aperture 106 is formed at the upper end of the mast 92 to slidingly receive the line 104 therethrough.

The body sail 90 shown in FIG. 6 is of simple construction and yet it is separable to enable convenient storage and transport when it is broken apart into its separate pieces. Yet, the body sail 90 shown in FIG. 6 provides complete control for the user since the bottom end of the mast 94 is received within the connector 20 which is movably mounted about the body of the user or an exterior floatation device by means of a belt or strap 26.

Thus, there has been disclosed a unique body sail which is usable to propel a user through the water. The body sail is constructed of a minimum number of lightweight components for a low manufacturing cost and, due to the pivotal and rotatable nature of the mounting of the body sail on the body of the user, it is easily maneuverable through the water in many wind and water conditions.

What is claimed is:

1. An apparatus for propelling the body of a user through the water comprising:

an upright mast;

means for pivotally, rotatably and movably mounting the mast on the body of the user comprising a disk-shaped member, and belt means slidably insertable through the disk-shaped member and releasably attachable around the body of the user, wherein the disk-shaped member may be moved along the belt means to any desired position around the body of the user while the apparatus is in use;

a boom pivotally attached to the mast and capable of being moved from a first extended position substantially perpendicular to the mast to a second collapsed position substantially parallel thereto; and a first sail attachable between the boom and the mast.

2. The apparatus of claim 1 wherein the boom includes:

first and second members, each of the first and second members being pivotally attached at one end to the mast and capable of being moved from a first extended position substantially perpendicular to the mast to a second collapsed position substantially parallel thereto.

3. The apparatus of claim 2 wherein the first and second boom members are telescopingly extendable.

4. The apparatus of claim 3 wherein the mast includes first and second telescopingly extendable sections.

5. The apparatus of claim 2 further including a second sail mountable between the mast and second boom member.

6. The apparatus of claim 5 further including means for movably connecting one end of the second sail to the boom for changing the trim of the second sail.

7. The apparatus of claim 6 wherein the connecting means includes:

at least one handle;

means for pivotally connecting one end of the handle to the boom;

means, mounted on the one handle for receiving a line attached to one end of the second sail for changing the shape of the second sail.

8. The apparatus of claim 7 further including a second handle pivotally mounted on the apparatus opposed to the first handle and receiving a portion of the line therethrough.

9. The apparatus of claim 2 further including means for removably attaching the first and second boom members on the mast.

10. The apparatus of claim 9 further including means for pivotally connecting one end of each of the first and second boom members to the apparatus.

11. The apparatus of claim 1 further including means for mounting the boom to the mast, the mounting means being vertically movable along the length of the mast for varying the position of the boom along the length of the mast.

12. The apparatus of claim 1 further comprising:

the mast having first and second separable sections;

an extension member removably receiving one end of each of the first and second mast sections to increase the length of the mast; and fastening means for securing opposite ends of the extension member to the ends of the first and second mast sections.

13. An apparatus for propelling the body of a user through the water comprising:

an upright mast;

means for pivotally, rotatably and movably mounting the mast on the body of the user comprising a disk-shaped member, and belt means slidably insertable through the disk-shaped member and releasably attachable around the body of the user, wherein the disk-shaped member may be moved along the belt means to any desired position around the body of the user;

a boom pivotally attached substantially perpendicular to the mast and extending outward therefrom;

a first sail attachable between the boom and the mast;

said boom including first and second members each being pivotally attached at one end to the mast and extending substantially perpendicular outward therefrom;

a second sail mountable between the mast and second boom member; and means for removably connecting one end of the second sail to the boom for changing the trim of the second sail, wherein said connecting means includes at least one handle, means for pivotally connecting one end of the handle to the boom, and means mounted on the one handle for receiving a line attached to one end of the second sail for changing the shape thereof.

14. *The apparatus of claim* 13 *further including a* second handle pivotally mounted on the apparatus opposed to the first handle and receiving a portion of the line therethrough.

* * * * *